United States Patent [19]

Holmes

[11] Patent Number: 4,829,693

[45] Date of Patent: May 16, 1989

[54] QUICK RELOADING DEVICES

[76] Inventor: Douglas Holmes, 4344 Broadway St., Lake Worth, Fla. 33461

[21] Appl. No.: 930,888

[22] Filed: Nov. 17, 1986

[51] Int. Cl.[4] ..... F42B 39/06

[52] U.S. Cl. ..... 42/87

[58] Field of Search ..... 42/87, 90

[56] References Cited

U.S. PATENT DOCUMENTS

| | | | |
|---|---|---|---|
| 2,137,491 | 11/1938 | Huff | 42/90 |
| 2,514,277 | 7/1950 | Donnallan | 42/90 |
| 2,862,324 | 12/1958 | Ball | 42/50 |
| 2,864,193 | 12/1958 | Drew | 42/87 |
| 3,509,655 | 5/1970 | Wilhelm | 42/87 |
| 4,464,855 | 8/1984 | Musgrave | 42/87 |
| 4,488,371 | 12/1984 | Boyles | 42/90 |
| 4,570,371 | 2/1986 | Mears | 42/90 |
| 4,689,909 | 9/1987 | Howard | 42/87 |

FOREIGN PATENT DOCUMENTS

| | | | |
|---|---|---|---|
| 304379 | 2/1921 | Fed. Rep. of Germany | 42/90 |
| 555367 | 8/1943 | United Kingdom | 42/90 |

*Primary Examiner*—Charles T. Jordan

*Attorney, Agent, or Firm*—Terry M. Gernstein

[57] ABSTRACT

A first embodiment of an ammunition clip reloading device comprises an L-shaped member attachable to the pin associated with the spring of a conventional clip. An outwardly extending portion of the member is designed to receive the thumb of a user so as to depress the clip spring to thus make the loading of ammunition substantially easier. A second embodiment of the invention comprises a thumb manipulated slide member positionable over a conventional ammunition clip. An adjustable guide extends above the body portion of the member and is operable to push a bullet into the clip in response to a downward pressure by the user's thumb.

4 Claims, 2 Drawing Sheets

QUICK RELOADING DEVICES

BACKGROUND OF THE INVENTION

1. Field of the Invention

The present invention relates to ammunition loading mechanisms, and more particularly pertains to improved clip spring depression devices which make the loading of ammunition into a clip substantially easier.

2. Description of the Prior Art

As is well known in the prior art, ammunition clips are utilized to hold a plurality of individual bullets with the clip then being subsequently positioned in a firearm intended to be fired. Such a conventional magazine employs a hollow housing having a follower slidably disposed therein. The follower is normally spring biased towards an open end of the housing, while a slot in the side of the housing accommodates the passage of a button fastened to the follower so that the user may depress the follower against the spring bias during a loading of the bullets into the clip. An alternative clip construction permits the introduction of ammunition one bullet at a time through a recess into contact with the follower. The ammunition forces the follower against the bias of a spring so as to accomplish the same ammunition loading function as with the first embodiment of clip above-described.

As can be appreciated, the loading operation of a clip can result in a user's thumb experiencing substantial discomfort. In response to the need for hold down mechanisms which restrain a clip spring, several patents have issued directed to devices for accomplishing just that purpose. For example, reference may be had to U.S. Pat. No. 2,137,491 which issued to W. Huff on Nov. 22, 1938. In this respect, the Huff device relates to an L-shaped member which is positionable over a clip follower button so as to give an increased surface contact area for the user's thumb. The member is provided with a knurled surface to improve the friction grip of the user's thumb, with the device then being slidable along the clip to effect the downward desired compression of the clip spring.

A more recent hold down latch apparatus is disclosed in U.S. Pat. No. 4,488,371, which issued to E. Boyles on Dec. 18, 1984. The hold down latch disclosed in this reference is designed to relieve spring tension from the follower slidable in the magazine housing, and includes an elongated body having a hook forming a portion thereof. The hook is positionable over the follower button, with the entire body then being slidable down along the clip to effect the desired spring compression.

While both of the above-described hold down latch apparatuses for ammunition clips are functional for their intended purposes, neither has apparently met with substantial commercial acceptance. Additionally, neither device is adapted for use with those types of clips wherein the ammunition is introduced through a recess in a topmost portion thereof. As such, it can be appreciated that there exists a continuing need for new and improved clip reloading systems and devices which may be inexpensively manufactured and easily used, and in this respect, the present invention substantially fulfills this need.

SUMMARY OF THE INVENTION

In view of the foregoing disadvantages inherent in the known types of hold down latch apparatuses now present in the prior art, the present invention provides two embodiments of hold down latch apparatuses for ammunition clips wherein they can be utilized with either type of conventional ammunition clip, while also being adjustable where needed to accommodate different sizes of clips and ammunition. As such, the general purpose of the present invention, which will be described subsequently in greater detail, is to provide new and improved hold down latch apparatuses for ammunition clips which have all the advantages of the prior art hold down latch apparatuses and none of the disadvantages.

To attain this, a first embodiment of the invention comprises an L-shaped member which has one leg thereof directly attachable to a follower button associated with a conventional spring-loaded ammunition clip. The outwardly extending remaining leg may then be depressed by a user's thumb to effect a compression of the clip spring. In the second embodiment of the invention, a housing is slidably positionable over a top loaded ammunition clip, with an upwardly extending adjustable member then being provided for guiding bullets, one at a time, into the clip receiving slot. The slidable member is provided with an outwardly extending thumb depression point to facilitate the guided positioning of a bullet in the clip.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide new and improved hold down latch apparatuses for ammunition clips which have all the advantages of the prior art hold down latch apparatuses for ammunition clips and none of the disadvantages.

It is another object of the present invention to provide new and improved hold down latch apparatuses for ammunition clips which may be easily and efficiently manufactured and marketed.

It is a further object of the present invention to provide new and improved hold down latch apparatuses for ammunition clips which are of a durable and reliable construction.

An even further object of the present invention is to provide new and improved hold down latch apparatuses for ammunition clips which are susceptible of a low cost of manufacture with regard to both materials and labor, and which accordingly are then susceptible of low prices of sale to the consuming public, thereby making such hold down latch apparatuses for ammunition clips economically available to the buying public.

Still yet another object of the present invention is to provide new and improved hold down latch apparatuses for ammunition clips which provide in the apparatuses and methods of the prior art some of the advantages thereof, while simultaneously overcoming some of the disadvantages normally associated therewith.

Still another object of the present invention is to provide new and improved hold latch apparatuses for ammunition clips which may be adjusted to accommodate different sizes of ammunition and clips.

Yet another object of the present invention is to provide new and improved hold latch apparatuses for ammunition clips which rapidly and efficiently permit a compression of conventional ammunition clip springs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
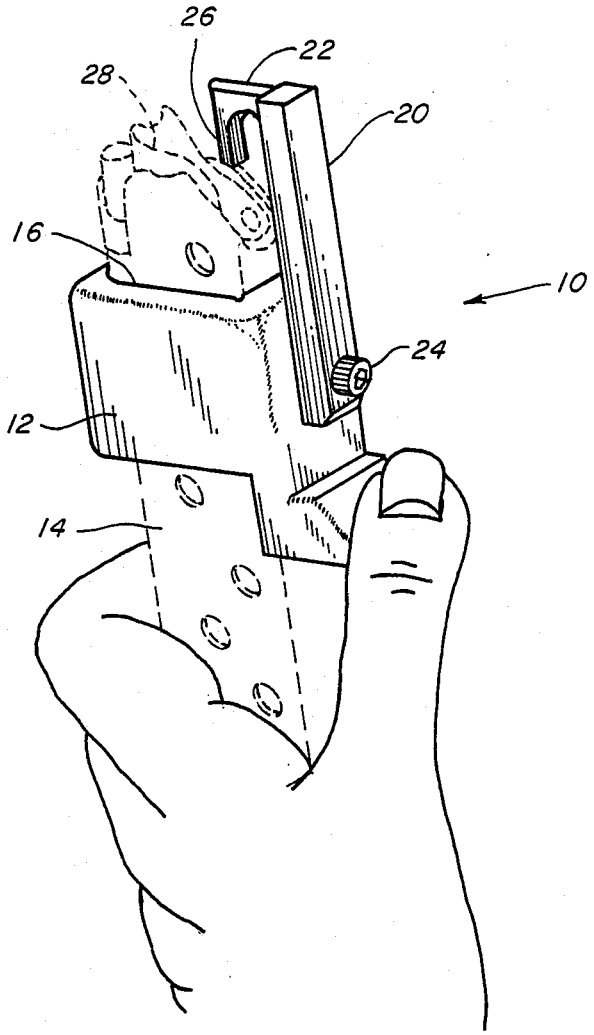
FIG. 1 is a perspective view of a first embodiment of a hold down latch apparatus for an ammunition clip comprising the present invention.
Figure 2:
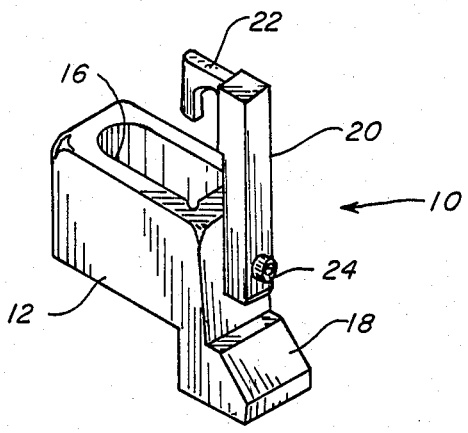
FIG. 2 is a further perspective view of the first embodiment of the invention.

With reference now to the drawings, and in particular to FIGS. 1 and 2 thereof, a new and improved hold down latch apparatus for an ammunition clip embodying the principles and concepts of the present invention and generally designated by the reference numeral 10 will be described.

More specifically, it will be noted that the first embodiment 10 of the invention essentially comprises a housing 12 which is slidably positionable over a conventional ammunition clip 14. In this respect, the ammunition clip 14 is slidably positionable upwardly through a through-extending cutout 16 formed along an axial length of the housing 12. Integrally or otherwise attached to the housing 12 is an outwardly extending portion 18 which essentially comprises a thumb depression member designed to receive the thumb of a user. Removably attached to the housing 12 is an upwardly extending member 20 having a U-shaped outwardly extending portion 22 attached to a topmost portion thereof. The upstanding member 20 may be adjustably attached to the housing 12 by some type of fastening means, such as though the use of a threaded fastener 24. In this regard, the threaded fastener 24 could be positioned within a slot 21 formed in the upstanding member 20 or could alternatively be receivable in a plurality of unillustrated threaded apertures formed in the housing 12. As such, height adjustment of the support member 20 relative to the housing 12 is facilitated.

With respect to the manner of usage and operation of the first embodiment 10 of the invention, it can be appreciated that the housing 12 may be slidably positioned over a conventional top loading ammunition clip 14 as illustrated in FIG. 1, and is slidably movable upwardly and downwardly along the clip through the positioning of the user's thumb on the thumb depression member 18. The U-shaped member has a downwardly extending portion 26 which is abuttable against a bullet placed in the loading slot 28, and a subsequent downward movement of the housing 12 will cause the U-shaped member 22 to force the bullet into the clip 14 against the force of the follower spring. Depending upon the size of the bullet being loaded into the clip 14, heightwise adjustment of the upstanding member 20 is afforded by the adjustment screw 24.

Figure 4:
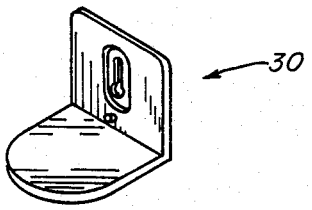
FIG. 4 is a further perspective view of the second embodiment of the invention.
Figure 3:
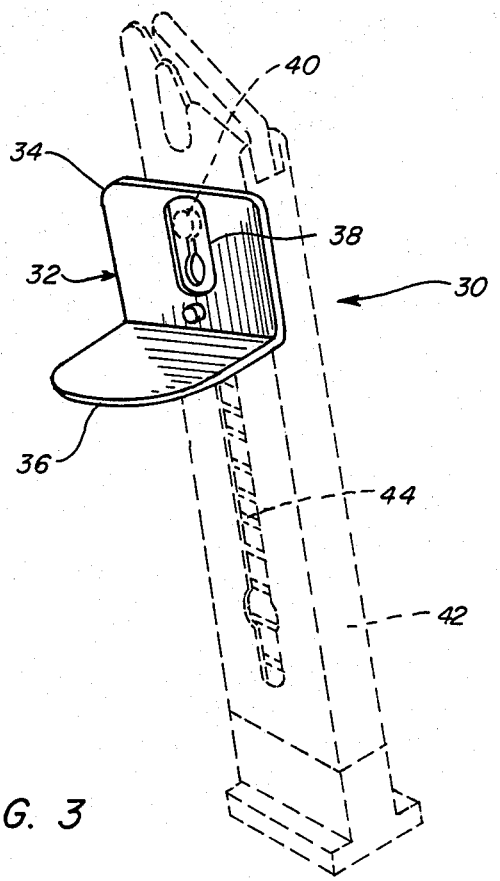
FIG. 3 is a perspective view of a second embodiment of the invention operably attached to an ammunition clip.

FIGS. 3 and 4 illustrate a second embodiment of the invention which is generally designated by the reference numeral 30. In this respect, the second embodiment 30 of the invention essentially comprises an integral L-shaped member 32 having a first leg 34 and a second outwardly extending leg 36. A slot 38 is formed in the first leg 34 of the member 32, which facilitates the attachment of the invention 30 over a follower button 40 associated with an ammunition clip 42.

With respect to the manner of usage and operation of the second embodiment 30 of the invention, it can be appreciated that once the slot 38 has been positioned over the conventional follower button 40, a user may place his thumb upon the outstanding member 36 and effect a downward movement of the member 32 along the clip 42. This will result in the compression of the clip spring 44 contained within the clip 42 so that bullets can be loaded into the clip without substantial difficulty.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A hold down latch apparatus for an ammunition clip comprising:

a. housing means;

b. a clip receiving aperture formed in said housing means, said ammunition clip being slidably positionable therein; and, c. bullet positioning means attached to said housing means, said bullet positioning means being operable to depress said bullet into said ammunition clip during a slidable movement of said housing means, said bullet positioning means being removably attached to said housing means, and said bullet positioning means being adjustable relative to said housing means, thereby to accommodate different sizes of bullets.

2. The hold down latch apparatus for an ammunition clip of claim 1, and further including thumb receiving means attached to said housing means, said thumb receiving means facilitating a positioning of a user's thumb against said housing means to effect a slidable movement thereof.

3. The hold down latch apparatus for an ammunition clip of claim 2, wherein said thumb receiving means is integrally formed in said housing means.

4. The hold down latch apparatus for an ammunition clip as described in claim 3, wherein said bullet positioning means includes a U-shaped member abuttable against a bullet being positioned for movement into said ammunition clip.

* * * * *